US005746280A

United States Patent [19]

Scott et al.

[11] Patent Number: 5,746,280

[45] Date of Patent: May 5, 1998

[54] EARTH-BORING BIT HAVING SHEAR-CUTTING INNER ROW ELEMENTS

[75] Inventors: Danny E. Scott, Montgomery; Rudolf Carl Otto Pessier; Turlach Paul Boylan, both of Houston, all of Tex.

[73] Assignee: Baker Hughes Incorporated, Houston, Tex.

[21] Appl. No.: 695,509

[22] Filed: Aug. 12, 1996

Related U.S. Application Data

[63] Continuation-in-part of Ser. No. 468,692, Jun. 6, 1996, Pat. No. 5,592,995.

[51] Int. Cl.[6] ..... E21B 10/16; E21B 10/52

[52] U.S. Cl. ..... 175/374; 175/428; 175/430; 175/431; 175/434

[58] Field of Search ..... 175/434, 426, 175/428, 431, 327, 430, 374, 420.1

[56] References Cited

U.S. PATENT DOCUMENTS

| | | | |
|---|---|---|---|
| 4,058,177 | 11/1977 | Langford, Jr. et al. | 175/374 |
| 4,334,586 | 6/1982 | Schumacher | 175/374 |
| 4,343,371 | 8/1982 | Baker, III et al. | 175/329 |
| 4,359,335 | 11/1982 | Garner | 75/208 |
| 4,694,918 | 9/1987 | Hall | 175/329 |
| 4,854,405 | 8/1989 | Stroud | 175/374 |
| 4,940,099 | 7/1990 | Deane et al. | 175/374 |
| 5,025,874 | 6/1991 | Barr et al. | 175/329 |
| 5,201,376 | 4/1993 | Williams | 175/374 |
| 5,282,512 | 2/1994 | Besson et al. | 175/37 |
| 5,287,936 | 2/1994 | Grimes et al. | 175/331 |
| 5,322,138 | 6/1994 | Siracki | 175/374 |
| 5,341,890 | 8/1994 | Cawthorn et al. | 175/374 |

FOREIGN PATENT DOCUMENTS

| | | | |
|---|---|---|---|
| 2 256 666 | 12/1992 | United Kingdom | E21B 10/16 |
| 2 274 129 | 7/1994 | United Kingdom | E21B 10/16 |

*Primary Examiner*—Frank Tsay
*Attorney, Agent, or Firm*—James E. Bradley

[57] ABSTRACT

An earth-boring bit has a bit body and at least one cantilevered bearing shaft depending inwardly and downwardly from the bit body. A cutter is mounted for rotation on the bearing shaft and includes a plurality of cutting elements arranged in generally circumferential rows, including inner heel rows, of cutting elements. At least one of the cutting elements in one of the inner rows has a crest at least partially formed of super-hard material that defines a cutting edge and cutting surface for shearing engagement with the bottom of the borehole during drilling operations, the remainder of the cutting end of the element is formed of hard, fracture-tough material for crushing engagement with the bottom of the borehole.

22 Claims, 5 Drawing Sheets

EARTH-BORING BIT HAVING SHEAR-CUTTING INNER ROW ELEMENTS

RELATED APPLICATIONS

This application is a continuation-in-part of application Ser. No. 08/468,692, filed Jun. 6, 1996. Now U.S. Pat. No. 5,592,995.

BACKGROUND OF THE INVENTION

1. Field of the Invention:

The present invention relates to earth-boring bits of the rolling cutter variety. Specifically, the present invention relates to the cutting structure of earth-boring bits of the rolling cutter variety.

2. Background Information

The success of rotary drilling enabled the discovery of deep oil and gas reserves. The rotary rock bit was an important invention that made that success possible. Only soft formations could be commercially penetrated but with the earlier drag bit, but the original rolling-cone rock bit invented by Howard R. Hughes, U.S. Pat. No. 939,759, drilled the hard caprock at the Spindletop field, near Beaumont Tex., with relative ease.

That venerable invention, within the first decade of this century, could drill a scant fraction of the depth and speed of the modern rotary rock bit. If the original Hughes bit drilled for hours, the modern bit drills for days. Bits today often drill for miles. Many individual improvements have contributed to the impressive overall improvement in the performance of rock bits.

Rolling-cone earth-boring bits generally employ cutting elements on the cutters to induce high contact stresses in the formation being drilled as the cutters roll over the bottom of the borehole during drilling operation. These stresses cause the rock to fail, resulting in disintegration and penetration of the formation material being drilled. Conventionally, the cutters roll on axes that are offset, or do not coincide with the geometric or rotational axis of the bit. Offset cutters do not purely roll over the bottom of the borehole, but also slide, imparting a gouging and scraping action to the cutting elements, in addition to the crushing mode of disintegration of formation material.

Shear cutting is a disintegration mode that is not taken maximum advantage of in the rolling-cutter earth-boring bit field as it is in the fixed-cutter or drag bit field. Shearing formation material is the dominant disintegration mode in fixed-cutter or drag bits, which commonly employ super-hard, highly wear-resistant cutting elements to shear formation material at the bottom and sidewall of the borehole.

Commonly assigned U.S. Pat. No. 5,287,936, Feb. 22, 1994 to Grimes et al. discloses a shear-cutting gage cutting structure for earth-boring bits of the rolling cutter variety. U.S. Pat. No. 5,282,512 discloses cutting elements for a rolling cutter bit with diamond-charged elements on the forward and central zones of the cutting elements to enhance the shearing or scraping mode of formation disintegration. As shown by U.S. Pat. No. 5,287,936, the shearing mode of disintegration is particularly advantageous employed at the corner and the sidewall of the borehole, where the gage or diameter of the borehole is defined. Maintenance of a full gage or diameter borehole is important to avoid sticking of the bit or other downhole equipment and to avoid the necessity of reaming operations to restore the borehole to the full gage or diameter condition.

A need exists, therefore, for earth-boring bits of the rolling-cutter variety having cutting structures that take advantage of the shearing mode of formation disintegration in addition to the crushing and gouging modes.

SUMMARY OF THE INVENTION

It is a general object of the present invention to provide an earth-boring bit of rolling cutter variety having a cutting structure with inner row cutting elements adapted to shearingly engage formation material during drilling operation.

This and other objects of the present invention are accomplished by providing an earth-boring bit having a bit body and at least one cantilevered bearing shaft depending inwardly and downwardly from the bit body. A cutter is mounted for rotation on the bearing shaft and includes a plurality of cutting elements arranged in generally circumferential rows, including inner heel rows, of cutting elements. At least one of the cutting elements in one of the inner rows has a crest at least partially formed of super-hard material that defines a cutting edge and cutting surface for shearing engagement with the bottom of the borehole during drilling operations, the remainder of the cutting end of the element is formed of hard, fracture-tough material for crushing engagement with the bottom of the borehole.

According to one embodiment of the present invention, the cutting edge is circular and defines a conical cutting surface.

According to one embodiment of the present invention, the cutting edge is polygonal and the intersections of the sides of the cutting edge define plow edges.

According to the preferred embodiment of the present invention, the super-hard portion is polycrystalline diamond, the remainder of the cutting element is formed of cemented tungsten carbide, and the element is interference fit into an aperture in the cutter surface.

DESCRIPTION OF THE PREFERRED EMBODIMENT

Figure 1:
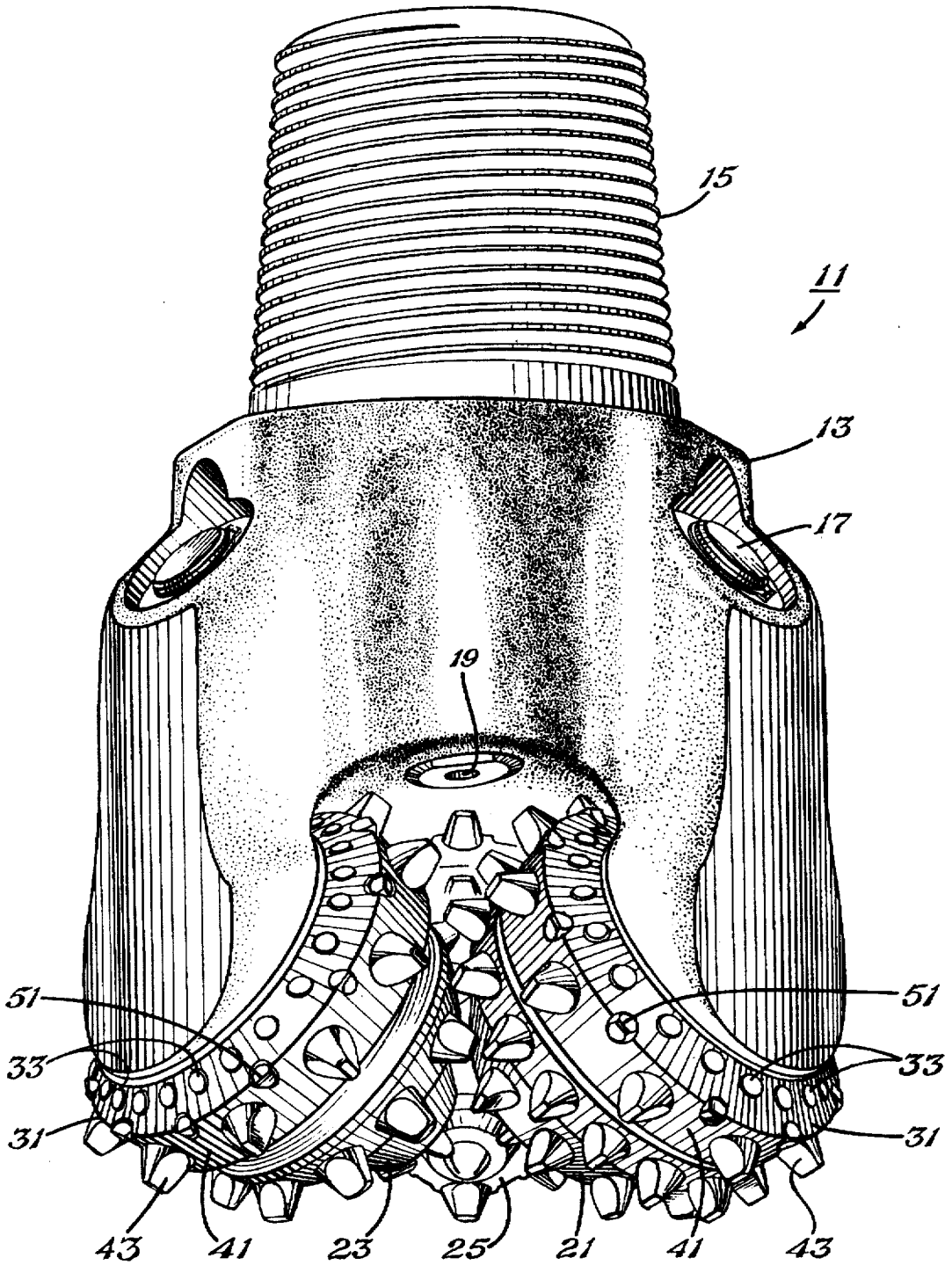
FIG. 1 is a perspective view of an earth-boring bit according to the present invention.

Referring now to the Figures, and particularly to FIG. 1, an earth-boring bit 11 according to the present invention is illustrated. Bit 11 includes a bit body 13, which is threaded at its upper extent 15 for connection into a drillstring. Each leg or section of bit 11 is provided with a lubricant compensator 17, a preferred embodiment of which is disclosed in U.S. Pat. No. 4,276,946, Jul. 7, 1981 to Millsapps. At least one nozzle 19 is provided in bit body 13 to spray drilling fluid from within the drillstring to cool and lubricate bit 11 during drilling operation. Three cutters, 21, 23, 25 are rotatably secured to a bearing shaft associated with each leg of bit body 13. Each cutter 21, 23, 25 has a cutter shell surface including a gage surface 31 and a heel surface 41.

A plurality of cutting elements, in the form of hard metal inserts, are arranged in generally circumferential rows on each cutter. Each cutter 21, 23, 25 has a gage surface 31 with a row of gage elements 33 thereon. A heel surface 41 intersects each gage surface 31 and has at least one row of heel inserts 43 thereon. At least one scraper element 51 is secured to the cutter shell surface generally at the intersection of gage and heel surfaces 31, 41 and generally intermediate a pair of heel inserts 43.

The outer cutting structure, comprising heel cutting elements 43, gage cutting elements 33, and a secondary cutting structure in the form of scraper elements 51, combine and cooperate to crush and scrape formation material at the corner and sidewall of the borehole as cutters 21, 23, 25 roll and slide over the formation material during drilling operation. The primary cutting structure accomplishing this task is the outer ends of heel cutting elements 43, while scraper cutting elements 51 form a secondary cutting structure assisting the heel elements 43. As the outermost surfaces of heel cutting elements 43 wear, gage cutting elements 33 engage the sidewall of the borehole to maintain gage diameter. The wear resistance and cutting efficiency of heel cutting elements 43 is enhanced by forming a portion of the outer end or outermost surface of elements 43 of a super-hard material defining a cutting edge for shearing engagement with the sidewall of the borehole, as depicted in greater detail in FIGS. 2, 3, and 4. The rows of cutting elements inward of heel rows 43 are referred to as inner rows, and there are several on each cutter.

Figure 2:
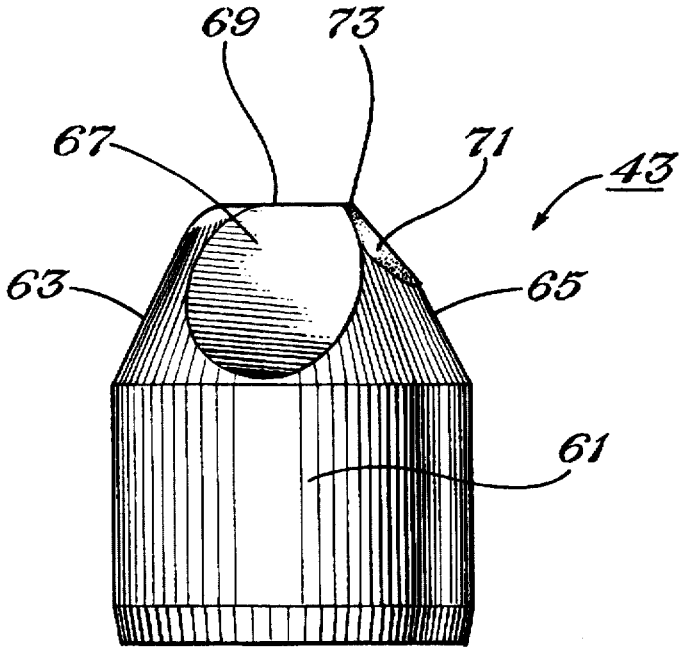
FIG. 2 is an elevation view of a heel cutting element of the earth-boring bit of FIG. 1.
Figure 3:
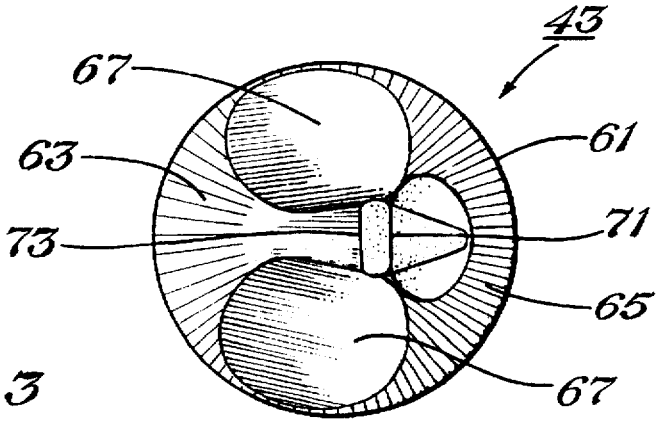
FIG. 3 is a plan view of the cutting element of FIG. 2.

FIGS. 2 and 3 are elevation and plan views, respectively, of a heel cutting element 43 according to the preferred embodiment of the present invention. Cutting element 43 comprises a generally cylindrical element body 61, which is preferably formed of a hard metal such as cemented tungsten carbide and is secured by interference fit in the cutter shell surface. The cutting end of element 43 includes an inner end 63 and an outer end 65, the terms inner and outer being defined relative to the center line of bit body 13, inner being closer to the center line and outer being more distant from the center line toward the sidewall of the borehole. A pair of flanks 67, which converge at an angle to define a crest 69, connect ends 63, 65 of element 43.

A portion of outer end or surface 65 of element 43 is formed of super-hard material 71, which is flush with crest 69 and defines a cutting edge 73 for shearing engagement with the sidewall of the borehole. Super-hard materials include natural diamond, polycrystalline diamond, cubic boron nitride and similar materials having hardnesses in excess of 2800 on the Knoop hardness scale. Super-hard materials are to be distinguished from cemented carbide materials and other hard metals, and are the materials used to cut, grind, and shape hard metals and other similar materials.

Preferably, as shown in FIG. 3, super-hard material 71 is a polygonal wedge of polycrystalline diamond cut from a circular diamond table. Wedge 71 is secured to element 43 by brazing, as disclosed in commonly assigned U.S. Pat. No. 5,355,750, Oct. 18, 1994 to Scott et al. Wedge 71 can also be formed integrally with element 43 in a high-pressure, high-temperature apparatus as disclosed in commonly assigned U.S. Pat. No. 5,355,750.

Figure 4:
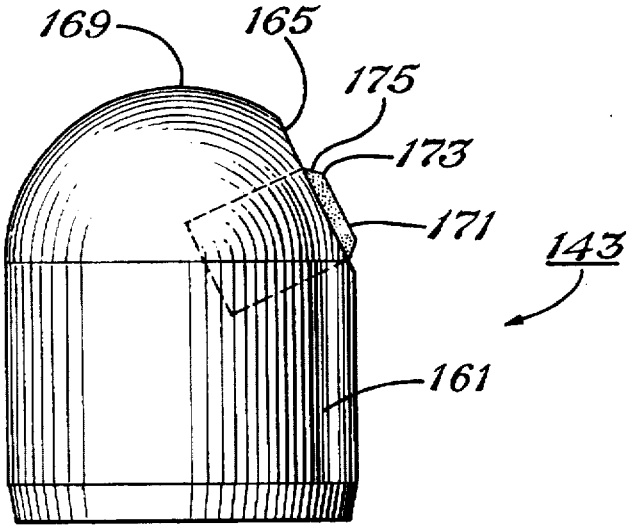
FIG. 4 is an elevation view of another embodiment of the heel cutting element according to the present invention.

FIG. 4 is an elevation view of another embodiment of a cutting element 143 according to the present invention. Unlike the embodiment of FIGS. 2 and 3, which is generally chisel-shaped and easily permits definition of a cutting edge 73 of super-hard material 71, element 143 has an ovoid cutting end that does not clearly define inner and outer ends or flanks, but does define a crest 169.

Element 143 has a flat outer surface 165 superimposed on the ovoid portion and adapted for engagement with the sidewall of the borehole during drilling operation. A disk 171 of super-hard material projects beyond outer surface 165 and defines a cutting edge 173 for shear-cutting engagement with the sidewall of the borehole. Preferably, the cutting edge projects no greater than 0.060 inch to avoid subjecting super-hard material 171 to excessive bending loads. The bevel of disk 171 provides a cutting or chip-breaking surface 175 that defines a negative rake angle with respect to the sidewall of the borehole. In this embodiment, disk 171 is a portion of super-hard core or cylinder extending through element 143.

Figure 5:
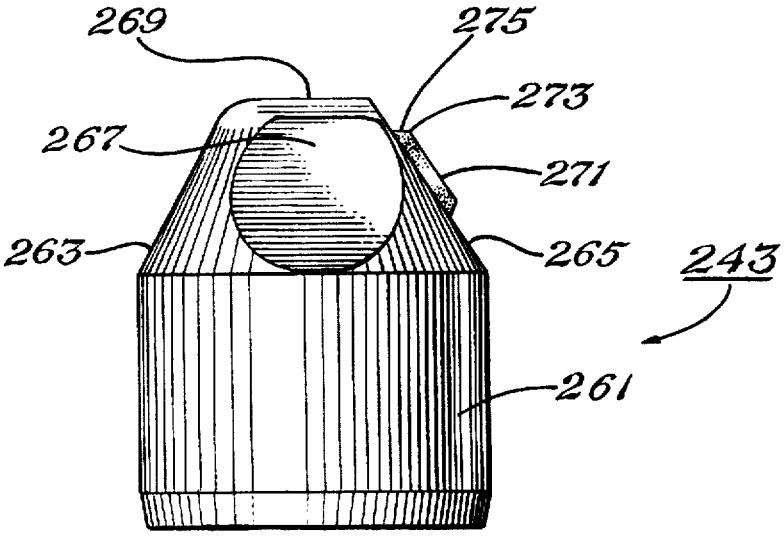
FIG. 5 is an elevation view of a heel cutting element according to the present invention.
Figure 6:
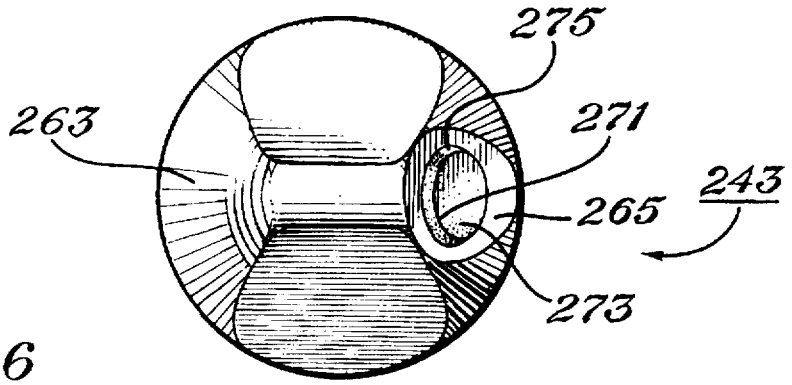
FIG. 6 is a plan view of the cutting element of FIG. 5.

FIGS. 5 and 6 are elevation and plan views of a cutting element 243 according to the present invention. Cutting element 243 is of the chisel-shaped configuration and has a cylindrical body 261 formed of cemented tungsten carbide. Inner and outer surfaces 263, 265 and a pair of flanks 267 converge to define a crest 269 to avoid exposure to impact loads occurring at the crest. Outer surface 265 is machined flat in this embodiment. A beveled disk 271 of super-hard material projects beyond outer surface or end 265 and defines a cutting edge 273 for shearing engagement with the sidewall of the borehole that is recessed from crest 269. Disk 271 of super-hard material is beveled to provide a cutting or chip-breaking surface 275 that defines a negative rake angle with respect to the sidewall of the borehole during drilling operation.

Figure 7:
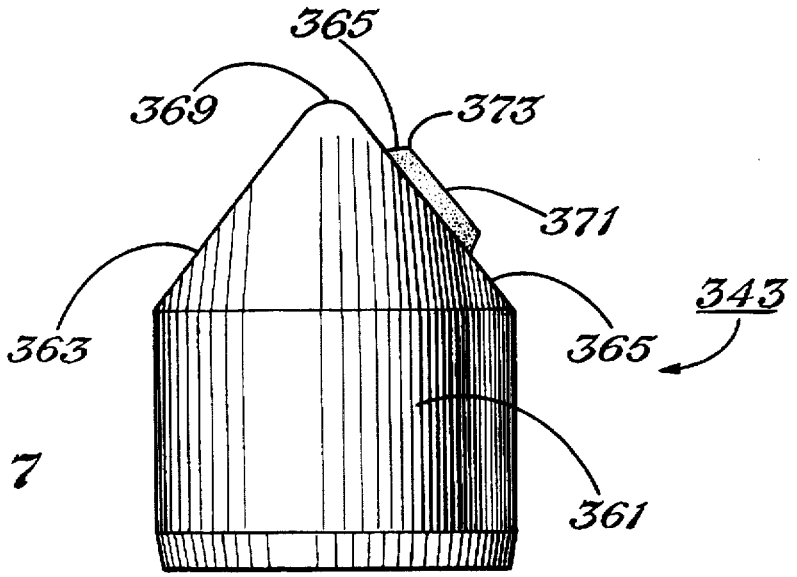
FIG. 7 is an elevation view of a heel cutting element according to the present invention.
Figure 8:
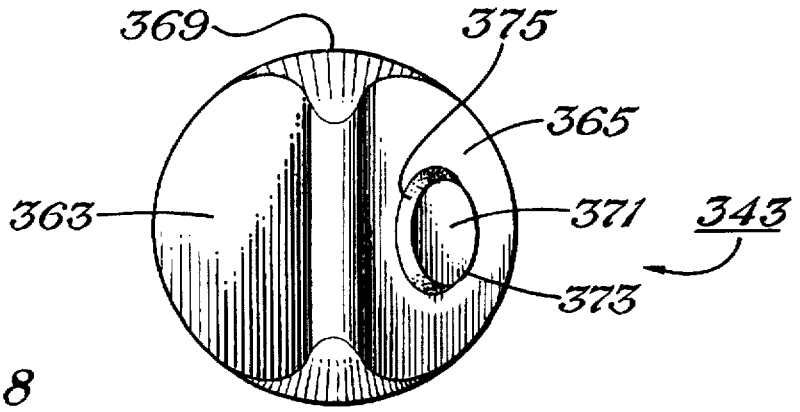
FIG. 8 is a plan view of the cutting element of FIG. 7.

FIGS. 7 and 8 are elevation and plan views, respectively, of another cutting element 343 according to the present invention. Cutting element 343 is configured such that when cylindrical body 361 is secured by interference fit in an aperture in heel surface 41, crest 369 of cutting element 343 is oriented transversely to the axis of rotation of each cutter 21, 23, 25. Thus, flanks 363, 365 of cutting element 343 define the inner and outer surfaces of cutting element 343, rather than the ends in more conventional chisel-shaped cutting elements. These larger surface areas are more wear-resistant that the smaller ends. A disk 371 of super-hard material is secured to outer flank 365 and defines a cutting edge 373 and cutting surface 375 for shearing engagement with the sidewall of the borehole.

Figure 10:
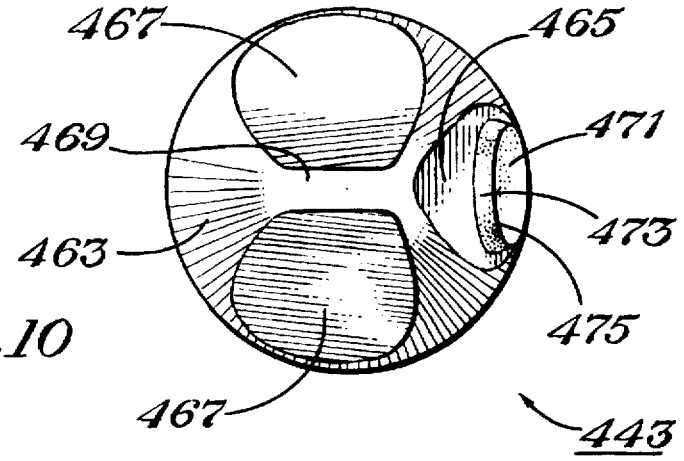
FIG. 10 is a plan view of the cutting element of FIG. 9.
Figure 9:
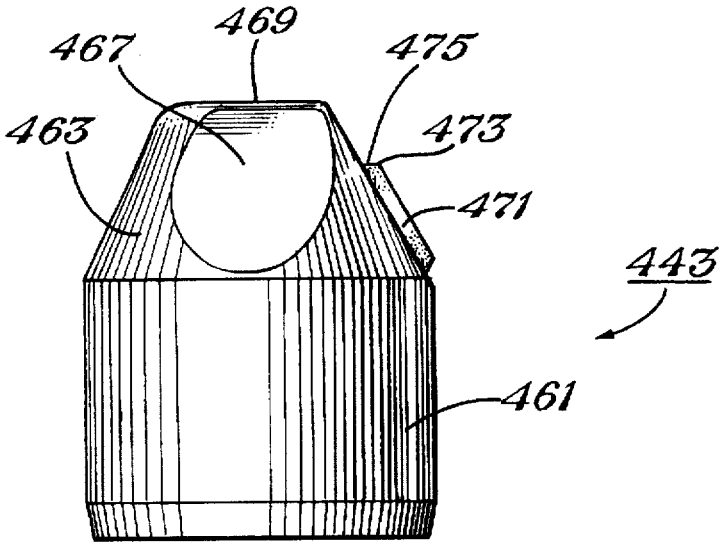
FIG. 9 is an elevation view of a heel cutting element according to the present invention.

FIGS. 9 and 10 are plan and elevation views, respectively, of another chisel-shaped cutting element 443 according to the present invention. A pair of flanks 467 converge from cylindrical body 461 to define a crest 469 formed of the cemented tungsten carbide material of body 461. A crest or cutting edge 473 of super-hard material 471 is formed on the outer end 465 and is recessed almost to the intersection of body 461 and end 465. With this recess, cutting edge 471 and cutting surface 475 are positioned to scrape the sidewall of the borehole further from the corner and bottom of the borehole, rendering cutting element 443 a more secondary cutting structure.

Figure 12:
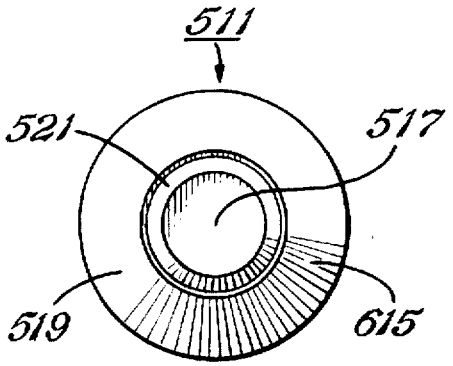
FIG. 12 is a plan view of the cutting element of FIG. 11.
Figure 11:
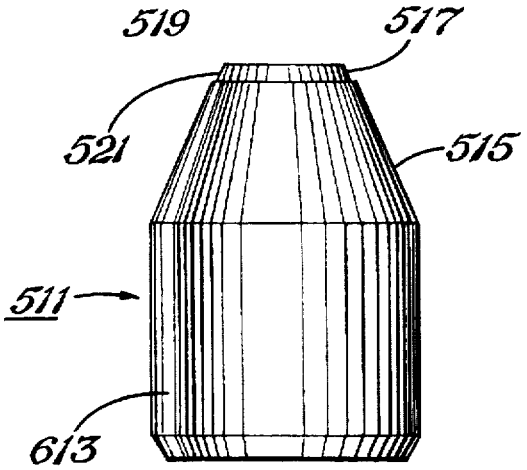
FIG. 11 is an elevation view of an inner row cutting element according to the present invention.

FIGS. 11–15 illustrate embodiments of cutting elements adapted for shear cutting application in the inner rows of cutting elements, inward of heel row cutting elements 43, 143, 243, 343, 443. FIGS. 11 and 12 are elevation and plan views, respectively, of an inner row cutting element 511 according to the present invention. Cutting element 511 comprises a generally cylindrical body 513 formed of conventional fracture-tough hard metal, preferably cemented tungsten carbide. A conical cutting end 515 extends from cylindrical body 513 and converges to terminate in an crest 517. Although a conical element is illustrated, other shapes, such as chisels, ovoids, and the like may be equally suitable for the present invention. Crest 517 is formed at least partially of super-hard material, preferably polycrystalline diamond, as described above, and defines a circular cutting edge 519 and a generally conical cutting surface. 517. During drilling operation, cutting edge 519 and cutting surface 521 shearingly engage the bottom of the borehole to induce fracture of formation material. The remainder of cutting end 515 is formed of fracture-tough cemented tungsten carbide to crush the bottom of the borehole.

Figure 13:
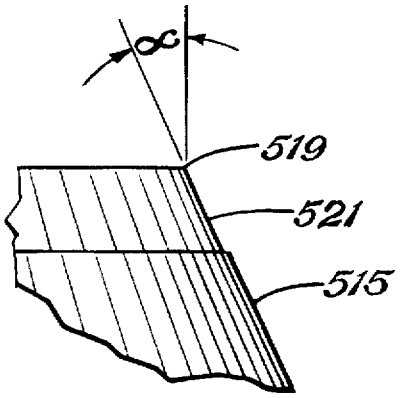
FIG. 13 is an enlarged elevation view of a portion of the cutting element of FIG. 11.

FIG. 13 is an enlarged, partial elevation view of the crest of cutting element 511 illustrated in FIGS. 11 and 12. As illustrated, cutting surface 521 intersects the flat upper surface of the super-hard material to define a sharp cutting edge 519. The angle of the intersection a is preferably between 15° and 60° from vertical to define a negative rake angle with respect to formation material engaged by cutting edge 519 and cutting surface 521.

Figure 15:
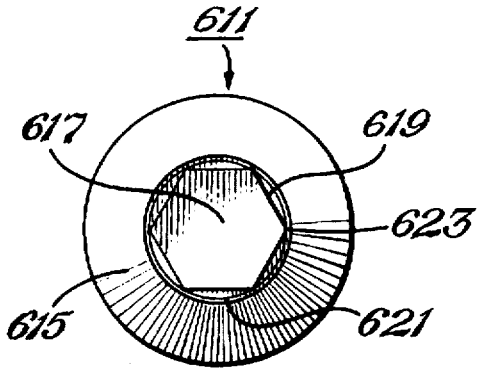
FIG. 15 is a plan view of the cutting element of FIG. 14.
Figure 14:
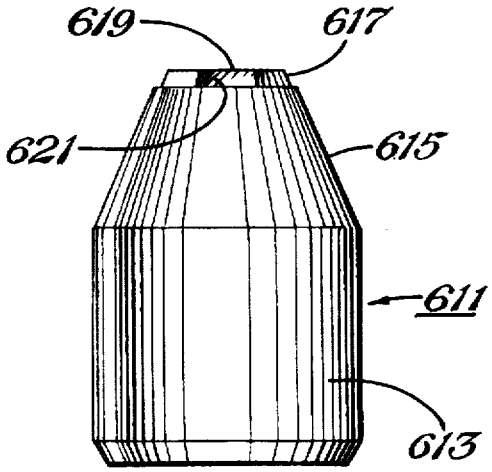
FIG. 14 is an elevation view of another embodiment of an inner row cutting element according to the present invention.

FIGS. 14 and 15 are elevation and plan views, respectively, illustrating another embodiment of a shear-cutting inner row cutting element 611 according to the present invention. The embodiment illustrated in FIGS. 14 and 15 is similar to that of FIGS. 11–13 and includes a cylindrical body 613 formed of cemented tungsten carbide. A conical cutting end 615, also formed of cemented tungsten carbide, extends from cylindrical body 613 and terminates in a crest 617 formed of super-hard material. While a conical cutting element is illustrated, other configurations, such as ovoids, chisels, and the like, are also contemplated by the present invention. The flat upper surface of crest 617 is in the form of a polygon, specifically a hexagon. Thus, a polygonal cutting edge 619 is defined. Each side of the polygon constitutes a cutting edge 619 and defines a corresponding cutting surface 621. Thus, in the embodiment of FIGS. 14 and 15, there are six cutting edges 619, and cutting surfaces 621. The intersections between the sides or cutting edges 619 of the hexagon or polygon form plow edges 623 substantially as disclosed in commonly assigned U.S. Pat. No. 5,346,026, Sep. 13, 1994 to Pessier et al., which is incorporated herein by reference.

During drilling operation, bit 11 is rotated and cutters 21, 23, 25 roll and slide over the bottom of the borehole and the cutting elements crush, gouge, and scrape the formation material. As heel elements 43, 143, 243, 343, 443 engage the sidewall of the borehole, super-hard cutting edges 73, 173, 273, 373, 473 scrape and shear formation material on the sidewall and in the corner of the borehole. Scraper elements 51 and gage elements 33 further assist in scraping and shearing the sidewall and corner. The remainder of super-hard material 71, 171, 271, 371, 471 on outer end or surface 65, 165, 265, 365, 465 of heel elements resists abrasive wear of this important area of cutting structure. The fracture-tough metal of the remainder of the heel elements 43, 143 243, 343, 443 gives crest 69, 169, 269, 369, 469 and flanks 67, 167, 267, 367, 467 sufficient strength and toughness to withstand the impact loads encountered by the cutting elements engaging the bottom of the borehole.

Similarly, inner row cutting elements 511, 611 induce formation fracture and failure through both shearing and crushing. Cutting edges 519, 619 and surfaces 521, 621 shear formation material while hard metal cutting ends 515, 615 crush and gouge formation material in the more conventional inner row disintegration mode.

The earth-boring bit according to the present invention has a number of advantages. A principal advantage is that the bit according to the present invention is provided with a heel and inner row cutting structure that advantageously employs the shearing mode of formation disintegration.

The invention has been described with reference to preferred embodiments thereof. It is thus not limited, but is susceptible to modification and variation without departing from the scope and spirit thereof.

We claim:

1. An earth-boring bit comprising:

a bit body;

at least one cantilevered bearing shaft depending inwardly and downwardly from the bit body;

a cutter mounted for rotation on the bearing shaft, the cutter including a plurality of cutting elements arranged in generally circumferential rows on the cutter, the generally circumferential rows including at least one inner row of cutting elements;

at least one of the cutting elements in an inner row having a cutting end with a crest at least partially formed of super-hard material and defining a cutting edge for shearing engagement with the bottom of the borehole during drilling operation.

2. The earth-boring bit according to claim 1 wherein the crest defines a circular cutting edge of super-hard material with an adjacent conical cutting surface intersecting the cutting edge.

3. The earth-boring bit according to claim 1 wherein the crest defines a polygonal cutting edge defining a plurality of sides, intersections between the sides of the polygonal cutting edge defining plow edges.

4. The earth-boring bit according to claim 1 wherein the cutting element in the inner row is conical in configuration, and the cutting end below the crest is formed of fracture-tough hard metal for crushing engagement with the bottom of the borehole.

5. The earth-boring bit according to claim 1 wherein the super-hard material is polycrystalline diamond and the remainder of the cutting element is formed of cemented tungsten carbide.

6. The earth-boring bit according to claim 1 wherein the cutting elements are secured by interference fit into apertures in the cutter surface.

7. The earth-boring bit according to claim 1 wherein each cutting element in an inner row has a cutting end with a crest at least partially formed of super-hard material and defining a cutting edge.

8. An earth-boring bit comprising:

a bit body;

at least one cantilevered bearing shaft depending inwardly and downwardly from the bit body;

a cutter mounted for rotation on the bearing shaft, the cutter including a plurality of cutting elements arranged in generally circumferential rows on the cutter, the generally circumferential rows including a plurality of inner rows of cutting elements;

at least one of the cutting elements in an inner row having a cutting end formed of fracture-tough hard metal and terminating in a crest at least partially formed of super-hard material and defining a cutting edge and cutting surface for shearing engagement with the bottom of the borehole during drilling operation.

9. The earth-boring bit according to claim 8 wherein the cutting edge is generally circular and the cutting surface is generally conical.

10. The earth-boring bit according to claim 8 wherein the cutting edge is polygonal and defines a plurality of sides, intersections between sides of the polygonal cutting edge defining plow edges.

11. The earth-boring bit according to claim 8 wherein the cutting element in the inner row is conical in configuration, and the cutting end below the crest is formed of fracture-tough hard metal for crushing engagement with the bottom of the borehole.

12. The earth-boring bit according to claim 8 wherein the super-hard material is polycrystalline diamond and the remainder of the cutting element is formed of cemented tungsten carbide.

13. The earth-boring bit according to claim 8 wherein the cutting elements are secured by interference fit into apertures in the cutter surface.

14. The earth-boring bit according to claim 8 wherein each cutting element in an inner row has a cutting end with a crest at least partially formed of super-hard material and defining a cutting edge and cutting surface.

15. An earth-boring bit comprising:

a bit body;

at least one cantilevered bearing shaft depending inwardly and downwardly from the bit body;

a cutter mounted for rotation on the bearing shaft, the cutter including a plurality of cutting elements arranged in generally circumferential rows on the cutter, the generally circumferential rows including at least one inner row of cutting elements;

at least one of the cutting elements in an inner row being formed of fracture-tough material and having a cutting end terminating in a crest at least partially formed of super-hard material and defining a cutting edge for shear cutting engagement with the bottom of the borehole during drilling operation, a portion of the cutting end below the crest being formed of fracture-tough material for crushing engagement with the bottom of the borehole during drilling operation.

16. The earth-boring bit according to claim 15 wherein the super-hard material is polycrystalline diamond and the fracture-tough material is cemented tungsten carbide.

17. The earth-boring bit according to claim 15 wherein the cutting elements are secured by interference fit into apertures in the cutter surface.

18. The earth-boring bit according to claim 15 wherein each cutting element in the heel row is generally chisel-shaped and includes an inner end, an outer end, and a pair of flanks converging to define a crest, a portion of the outer end being formed of super-hard material to define a cutting edge recessed from the crest for shear cutting engagement with the sidewall of the borehole.

19. The earth-boring bit according to claim 15 wherein each cutting element in the heel row is ovoid and the cutting edge of super-hard material is recessed from the crest.

20. The earth-boring bit according to claim 15 wherein each cutting element has a pair of ends, and inner and outer flanks that converge to define a crest oriented transversely to the rotational axis of the cutter, a portion of the outer flank being formed of the super-hard material, and the cutting edge is recessed from the crest.

21. The earth-boring bit according to claim 15 wherein the super-hard portion of the outer surface projects beyond the remainder of the outer surface for engagement with the sidewall of the borehole.

22. The earth-boring bit according to claim 15 further including a beveled cutting surface formed adjacent the cutting edge and formed of the super-hard material.

* * * * *